US005779495A

United States Patent [19]

Dechelette et al.

[11] Patent Number: 5,779,495

[45] Date of Patent: Jul. 14, 1998

[54] ELECTRICAL CONNECTOR WITH IMPROVED LATCHING SYSTEM

[75] Inventors: Patrick Dechelette, Le Plessis Robinson; Jerome Tamsson, Paris, both of France

[73] Assignee: Molex Incorporated, Lisle, Ill.

[21] Appl. No.: 676,616

[22] Filed: Jul. 10, 1996

[30] Foreign Application Priority Data

Aug. 26, 1995 [EP] European Pat. Off. ..... 95113426

[51] Int. Cl.[6] ..... H01R 13/627

[52] U.S. Cl. ..... 439/353; 439/352

[58] Field of Search ..... 439/350, 352, 439/353, 357, 358

[56] References Cited

U.S. PATENT DOCUMENTS

| | | | |
|---|---|---|---|
| 4,448,471 | 5/1984 | Berry et al. | 339/91 R |
| 4,762,505 | 8/1988 | Asick et al. | 439/347 |
| 4,787,860 | 11/1988 | Bender | 439/358 |
| 5,011,425 | 4/1991 | Van Zanten et al. | 439/353 |
| 5,197,895 | 3/1993 | Stupecky | 439/353 X |
| 5,312,276 | 5/1994 | Hnatuck et al. | 439/681 |
| 5,397,246 | 3/1995 | Defibaugh et al. | 439/352 |
| 5,637,010 | 6/1997 | Jost et al. | 439/352 |

*Primary Examiner*—Khiem Nguyen
*Attorney, Agent, or Firm*—A. A. Tirva

[57] ABSTRACT

An electrical connector includes a housing adapted for mating with a complementary electrical device along a mating axis. A latch is on the housing for latching the connector to the complementary electrical device. The latch is movable relative to the housing generally transversely of the mating axis. An actuator is mounted on the housing for movement relative thereto generally parallel to the mating axis. The actuator is coupled to the latch to convert axial movement of the actuator to transverse movement of the latch.

11 Claims, 6 Drawing Sheets

ELECTRICAL CONNECTOR WITH IMPROVED LATCHING SYSTEM

FIELD OF THE INVENTION

This invention generally relates to the art of electrical connectors and, particularly, to a latching means or system for latching an electrical connector to another mating connector or complementary electrical device.

BACKGROUND OF THE INVENTION

A typical electrical connector includes some form of housing means mounting a plurality of electrical terminals for interengagement of the terminals with the terminals of a mating connector or other complementary electrical device, thereby interconnecting a plurality of circuits through the mated connectors. One example is an electrical connector which terminates the conductors of an electrical wire and interconnects the conductors with circuit traces on a printed circuit board through a connecting device on the circuit board. The device on the board often is called a "header connector".

In addition, many mating electrical connectors have complementary interengaging latch means to hold the connectors in latched condition to prevent unintentional unmating of the connectors. This is particularly true with connectors that are mounted on printed circuit boards.

In the prior art, a typical latching system between a pair of mating electrical connectors, such as an electrical connector for mating with a header connector on a circuit board, employs some form of lever-type latch arm which has two free ends on opposite sides of a single or double fulcrum. The latch arm pivots to move latch hooks, for instance, into and out of engagement with latching recesses or shoulders on the complementary mating connector. Typically, a pair of latch arms are mounted on opposite sides of the connector.

A problem with these types of latching systems is that they take up considerable valuable space or "real estate" on the printed circuit board. Not only are the latch arms located on the outsides of the connectors, preventing adjacent electrical devices on the board from being positioned in close juxtaposition to the latching connector, but access must be had to the outsides of the connectors to effect unlatching of the connectors. In other words, the connector typically is mated with the header connector along a mating axis generally perpendicular to the circuit board, but the latching and unlatching action is effected in a direction transverse to the mating axis or generally parallel to the board. This often prevents mounting other electrical devices on the board in the immediate proximity of the latching connector.

The present invention is directed to solving these problems by providing an electrical connector with a unique latching system wherein unlatching actions are effected generally parallel to the mating axis of the connector.

SUMMARY OF THE INVENTION

An object, therefore, of the invention is to provide an electrical connector with a new and improved latching system or means.

In the exemplary embodiment of the invention, the connector includes a housing adapted for mating with a complementary electrical device along a mating axis. A latch is provided on the housing for latching the connector to the complementary electrical device. The latch is movable relative to the housing generally transversely of the mating axis. An actuator is mounted on the housing for movement relative thereto generally parallel to the mating axis. Generally, complementary interengaging coupling means are provided between the actuator and the latch for converting axial movement of the actuator to transverse movement of the latch.

More particularly, the latch is provided by a latch arm pivotally mounted on the housing for pivotal movement of a latching portion of the arm generally transversely of the mating axis. The latch arm is integral with the housing at a fulcrum which pivotally mounts the arm to the housing. The actuator is provided by a slide member slidably mounted on the housing for linear movement generally parallel to the mating axis. The housing includes at least two parts sandwiching at least a portion of the slide member therebetween. The latching portion of the latch arm is located on one axial side of the fulcrum, and the slide member includes a manually engageable operating portion located on the opposite axial side of the fulcrum.

Other features of the invention include the connector being adapted for terminating an electrical cable, and the housing and the actuator include opposing portions for embracing the cable. Stop means are provided on the housing engageable by the actuator to limit the amount of movement of the actuator generally parallel to the mating axis. Specifically, the stop limit means are provided by a pair of opposing, axially spaced stop shoulders on the housing, with a stop flange on the actuator located between the shoulders and engageable therewith.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
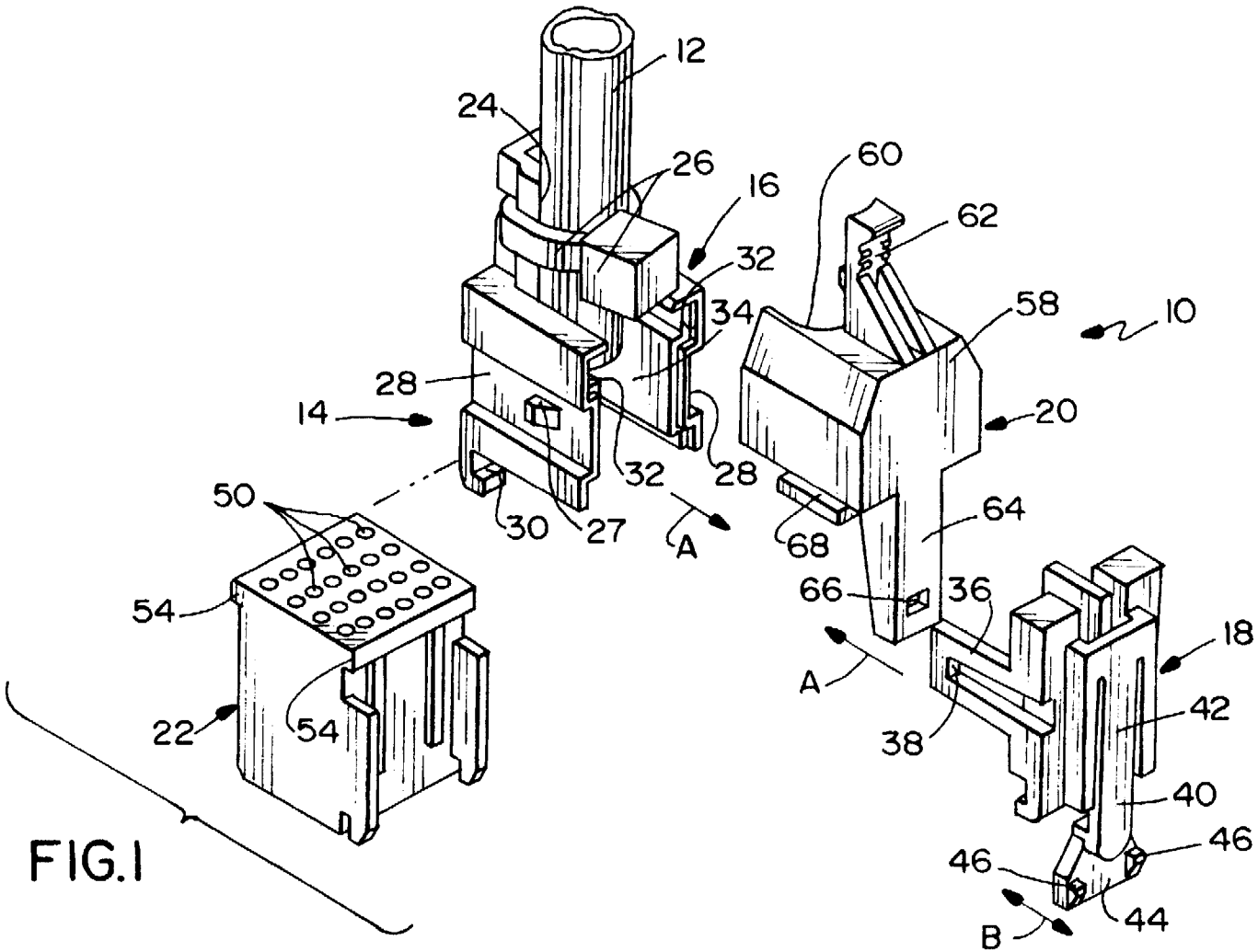
FIG. 1 is an exploded perspective view of an electrical connector embodying the concepts of the invention.
Figure 2:
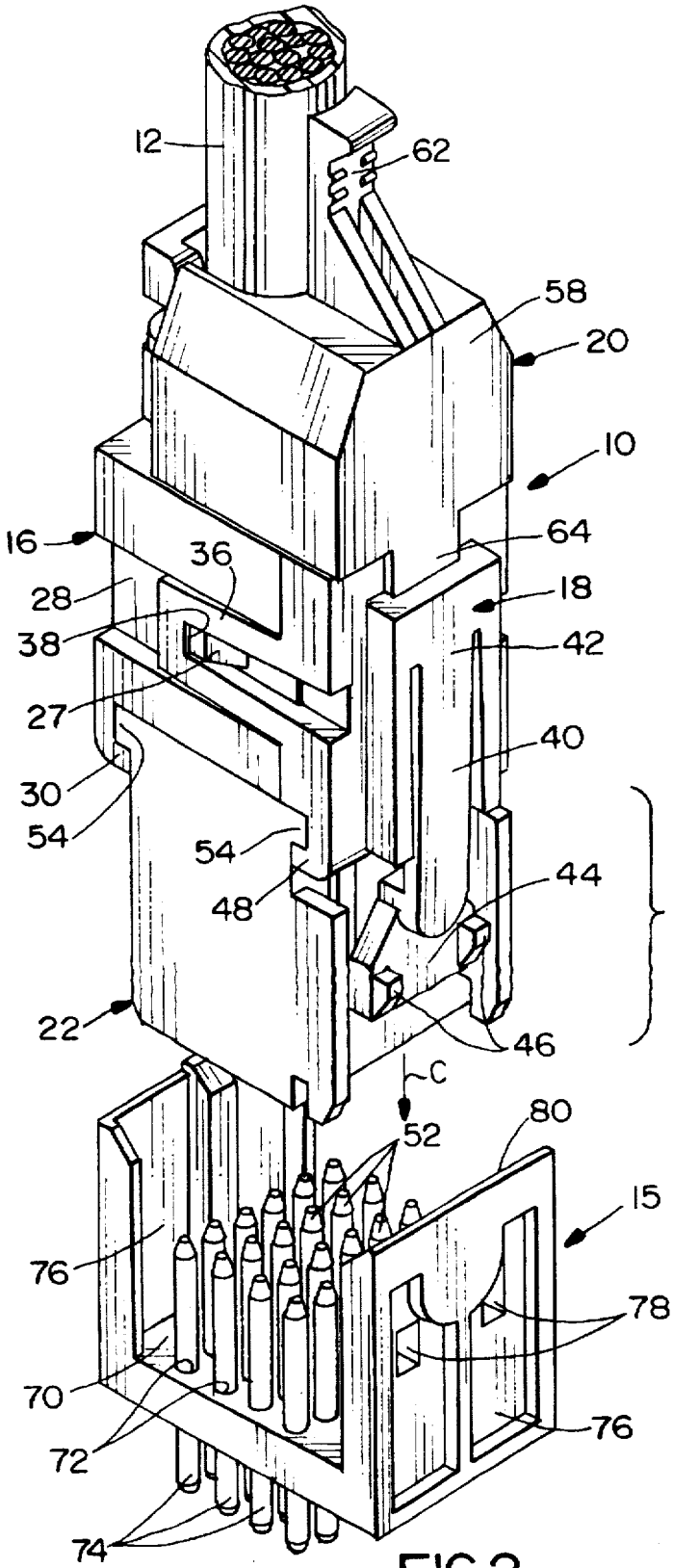
FIG. 2 is a perspective view of the connector about to be mated with a complementary header connector.
Figure 3:
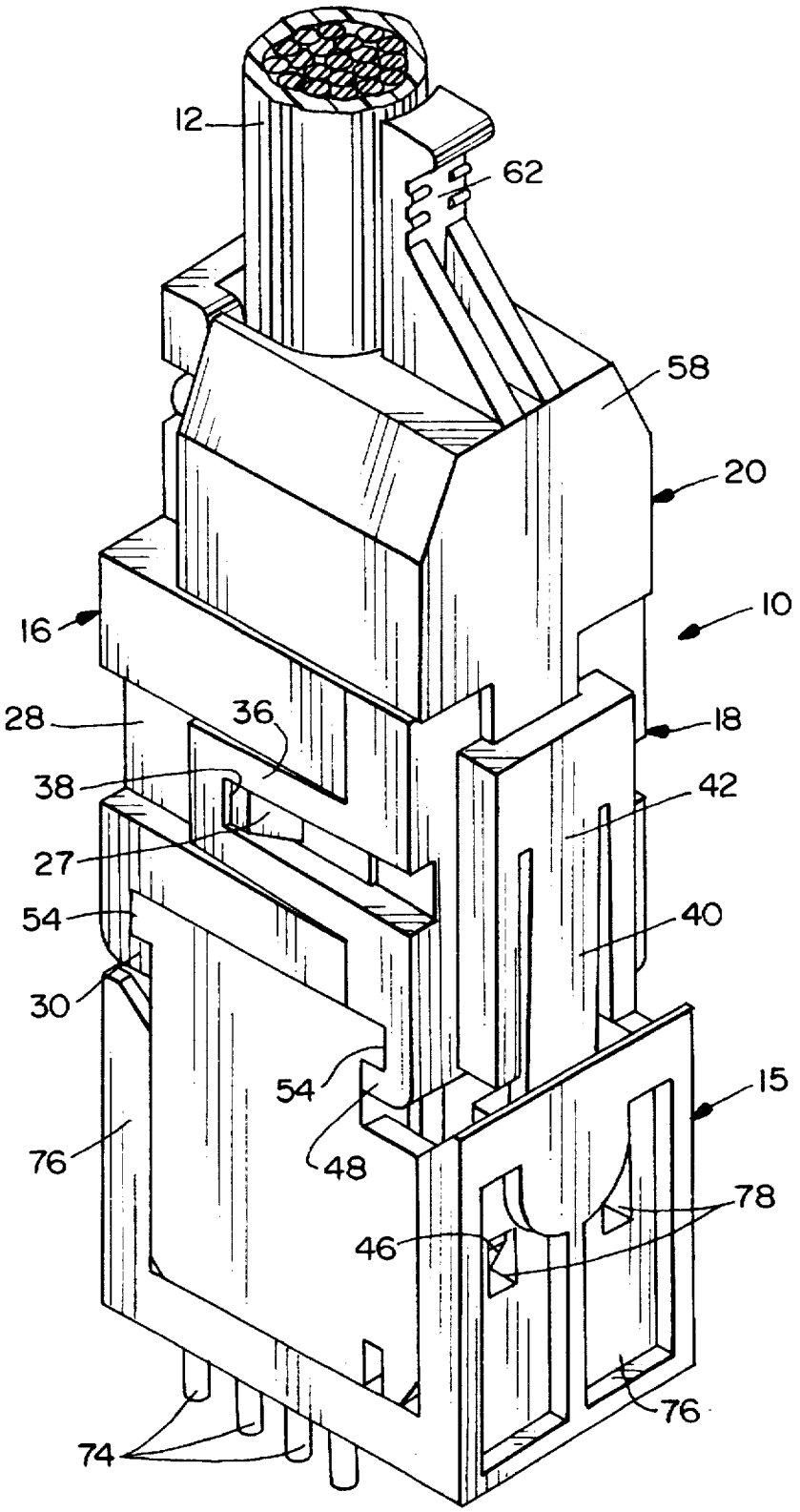
FIG. 3 is a view similar to that of FIG. 2, with the connector mated with the header connector.

Referring to the drawings in greater detail, and first to FIG. 1, an electrical connector, generally designated 10, is adapted for terminating the conductors of an electrical wire or cable 12 and interconnecting those wires to the terminal pins of a header connector, generally designated 15 in FIGS. 2 and 3. Connector 10 includes a housing, generally designated 14, which is formed of two parts, generally designated 16 and 18, which sandwich a latch actuator, generally designated 20, therebetween, along with a third housing part, generally designated 22.

First housing part 16 is unitarily molded of dielectric material such as plastic or the like and includes an upstanding yoke 24 for embracing one side of electrical cable 12. A cable tie 26 is adapted for surrounding the cable and tying the cable to yoke 24. A pair of chamfered latch bosses 27 project outwardly within a pair of horizontal recesses 28 on opposite sides of the housing for interconnecting housing part 16 with housing part 18, as described in greater detail hereinafter. Inwardly turned lips 30 are formed at the rear bottom area of housing part 16 for interconnecting the housing part with second housing part 18, as will be described in greater detail hereinafter. Lastly, housing part 16 has a pair of opposing horizontal grooves 32 facing inwardly toward an interior cavity 34 for interconnecting the housing part with actuator 20, again as will be described in greater detail hereinafter.

Second housing part 18 has a pair of latch arms 36 projecting rearwardly toward housing part 16. The latch arms have openings defining latching apertures 38 which interengage with latch bosses 27 of first housing part 16. In particular, the two housing parts are assembled toward each other in the direction of arrows "A" (FIG. 1). Second housing part 18 also is unitarily molded of dielectric material, such as plastic or the like, and latch arms 36 resiliently spread apart until they snap into engagement with latch bosses 27, with the bosses locking within latching apertures 38.

Second housing part 18 also has a main connector latch arm 40 molded integrally with the housing part and cantilevered about an integral fulcrum 42 such that a distal end 44 of the latch arm can pivot transversely to the mating direction of the connector in the direction of double-headed arrow "B" (FIG. 1). The distal end of the latch arm is provided with a pair of chamfered latch hooks 46. Lastly, second housing part 18 has a pair of inwardly turned lips 48, similar to lips 30 of first housing part 16 to interconnect the housing parts with third housing part 22 as described in greater detail below.

Third housing part 22 of connector 10 has a plurality of terminal-receiving through passages 50 shown in FIG. 1. These passages internally mount a plurality of conventional female or receptacle terminals (not shown) for mating with pin terminals 52 (FIG. 2) of header connector 15. Third housing part 22 has a pair of front and rear flanges 54 which are adapted to be embraced by lips 30 and 48 of first and second housing parts 16 and 18, respectively, when housing 14 is fully assembled. FIGS. 2 and 3 clearly show how flanges 54 are embraced by lips 30 and 48, while latch arms 36 and 38 of second housing part 18 lock with latch bosses 27 of first housing part 16 to hold the three-part housing in assembled condition.

Latch actuator 20 of connector 10 is a slide member and includes a body portion 58 defining a rear yoke 60 which combines with yoke 24 of first housing part 16 to embrace electrical cable 12. The actuator includes a manually engaging operating portion 62 projecting axially upwardly of body portion 58 and an actuating arm 64 projecting axially downwardly of the body portion. The actuating arm has a through aperture 66 for purposes described hereinafter. A pair of horizontal flanges 68 project outwardly from opposite sides of body portion 58 for riding into grooves 32 of first housing part 16. In assembly, actuator 20 is sandwiched between first and second housing parts 16 and 18, respectively. Like each of housing parts 16, 18 and 22, actuator 20 is unitarily molded of dielectric material, such as plastic or the like.

Header connector 15 (FIGS. 2 and 3) includes a base plate 70 having through apertures 72 (FIG. 2) for mounting terminal pins 52. The terminal pins have tail portions 74 for insertion into holes in a printed circuit board and for soldering the tails to circuit traces on the board and/or in the holes. The header connector has a pair of front and rear walls 76 projecting upwardly from base plate 70 to protect terminal pins 52. The front wall has a pair of main latch apertures 78 which are interengageable by latch hooks 46 at the distal end 44 of latch arm 40.

Electrical connector 10 is mated with header connector 15 in the direction of arrow "C" (FIG. 2) until the connectors are fully mated as shown in FIG. 3. During mating, chamfered latch hooks 46 at the distal end 44 of latch arm 40 on second housing part 18 engages a chamfered top edge 80 of front wall 76 of header connector 15 to bias latch arm 40 inwardly. In essence, the latch arm pivots transversely of mating axis "C" about its fulcrum 42. When the connectors are fully mated, latch hooks 46 snap back outwardly into latch aperture 78 of the header connector.

Figure 4:
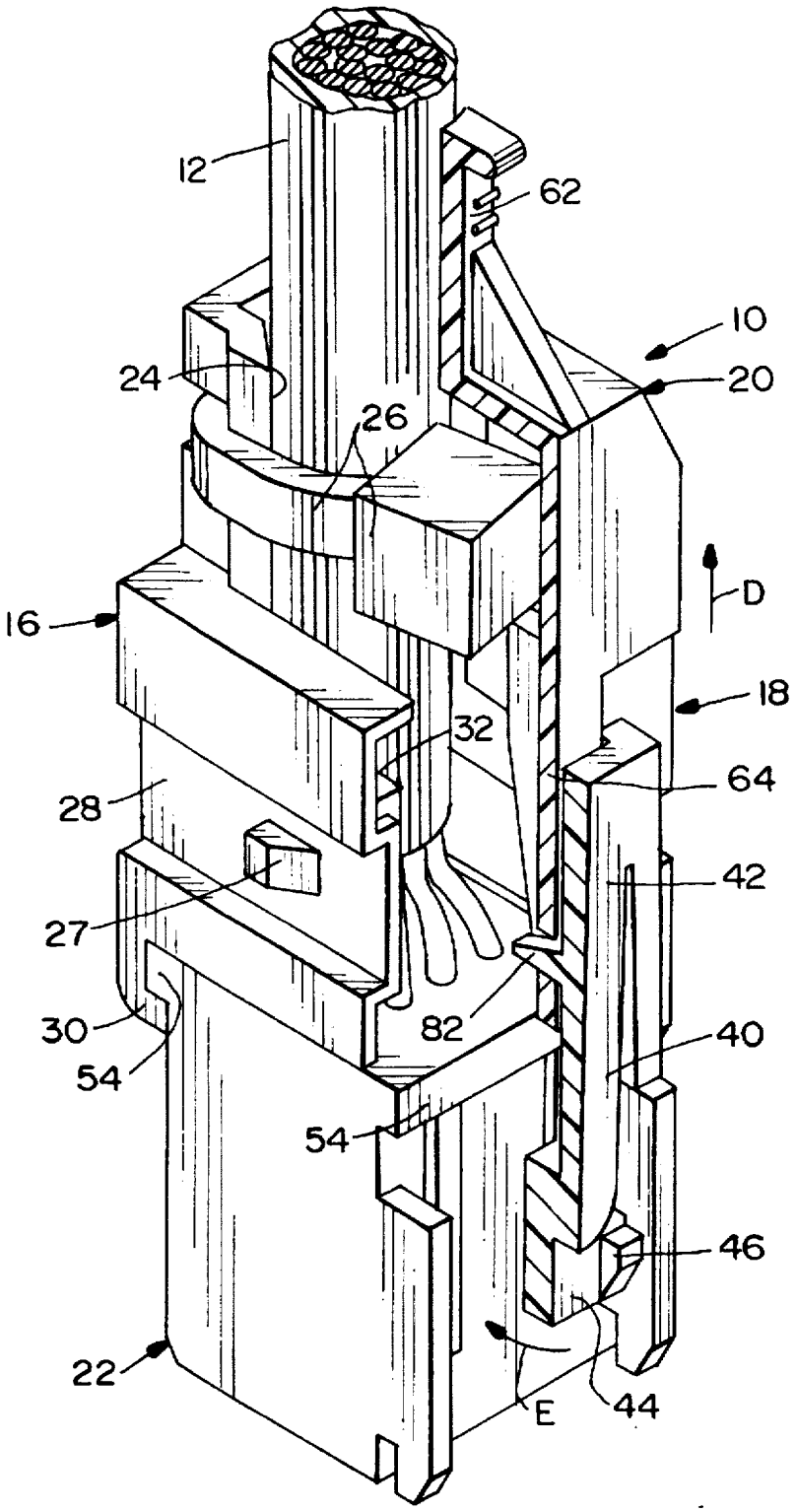
FIG. 4 is a perspective view of the connector, partially cut away to show some of the interior components thereof.
Figure 5:
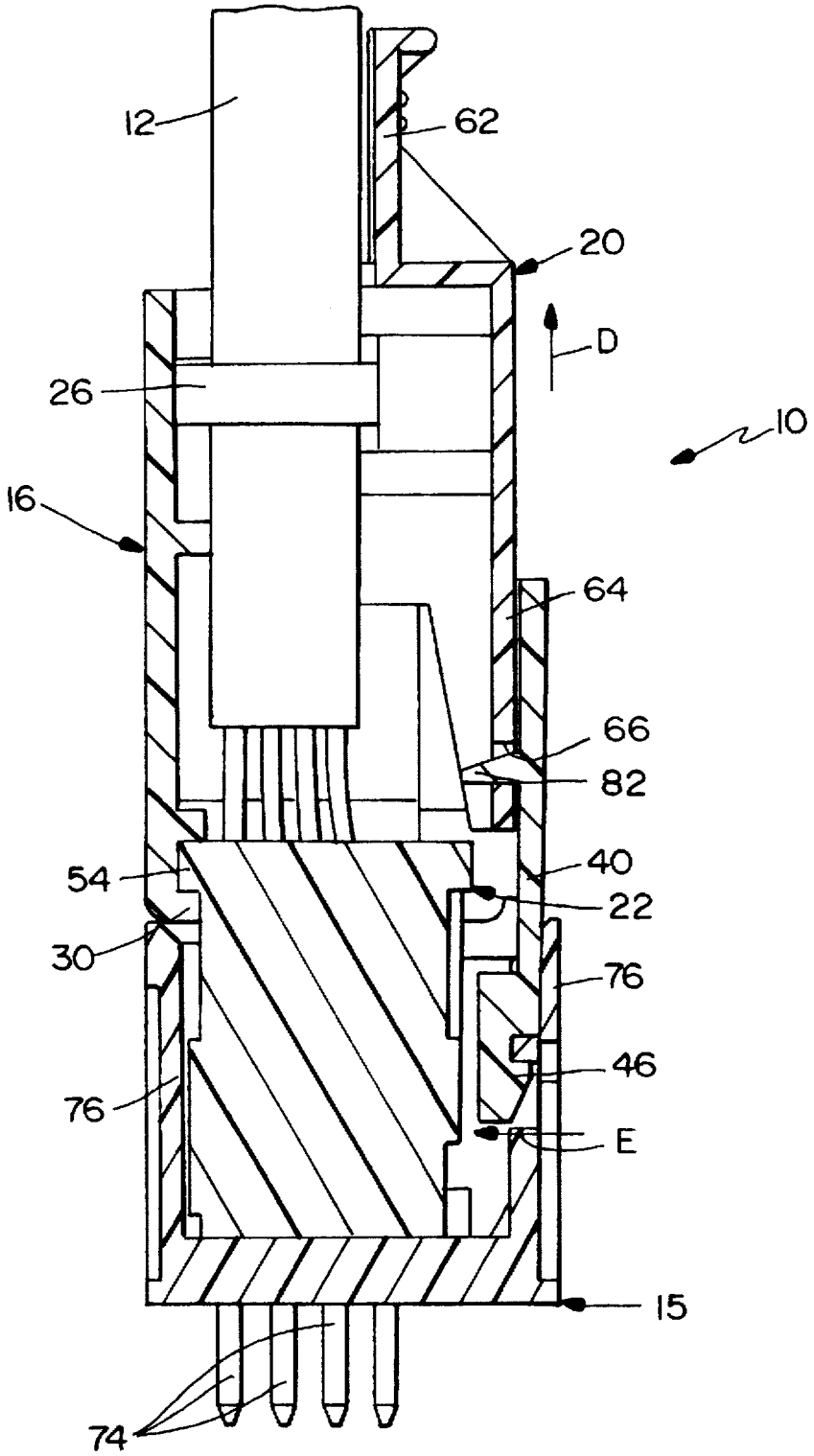
FIG. 5 is a vertical axial section through the connector mated with the header connector.

Generally, complementary interengaging coupling means are provided between actuator 20 and second housing part 18, specifically between actuator arm 64 and latch arm 40, for converting axial movement of the actuator to transverse movement of the latch arm. More particularly, referring to FIGS. 4 and 5, it can be seen that a coupling boss 82 projects rearwardly of latch arm 40 and into aperture 66 of actuator arm 64. It should be noted that the interengagement of coupling boss 82 within aperture 66 is below fulcrum 42 of latch arm 40. Therefore, when actuator 20 is moved upwardly in the direction of arrow "D" (FIGS. 4 and 5), as by an operator pulling on operating portion 62 of the actuator, actuator arm 64 is effective to pull on the inside of latch arm 40. The only direction for the latch arm to move in response to that pulling force is inwardly in the direction of arrow "E" generally transverse to the mating axis of the connectors. This transverse inward movement of distal end 44 of latch arm 40 is effective to move latch hooks 46 out of apertures 78 in header connector 14 to allow the two connectors to be unmated. In essence, the coupling between actuator 20 (particularly actuator arm 64) and latch arm 40 is effective to convert axial movement of the actuator to transverse movement of the latch arm. In other words, the coupling means converts linear movement of the actuator to pivotal movement of the latch arm.

Figure 6:
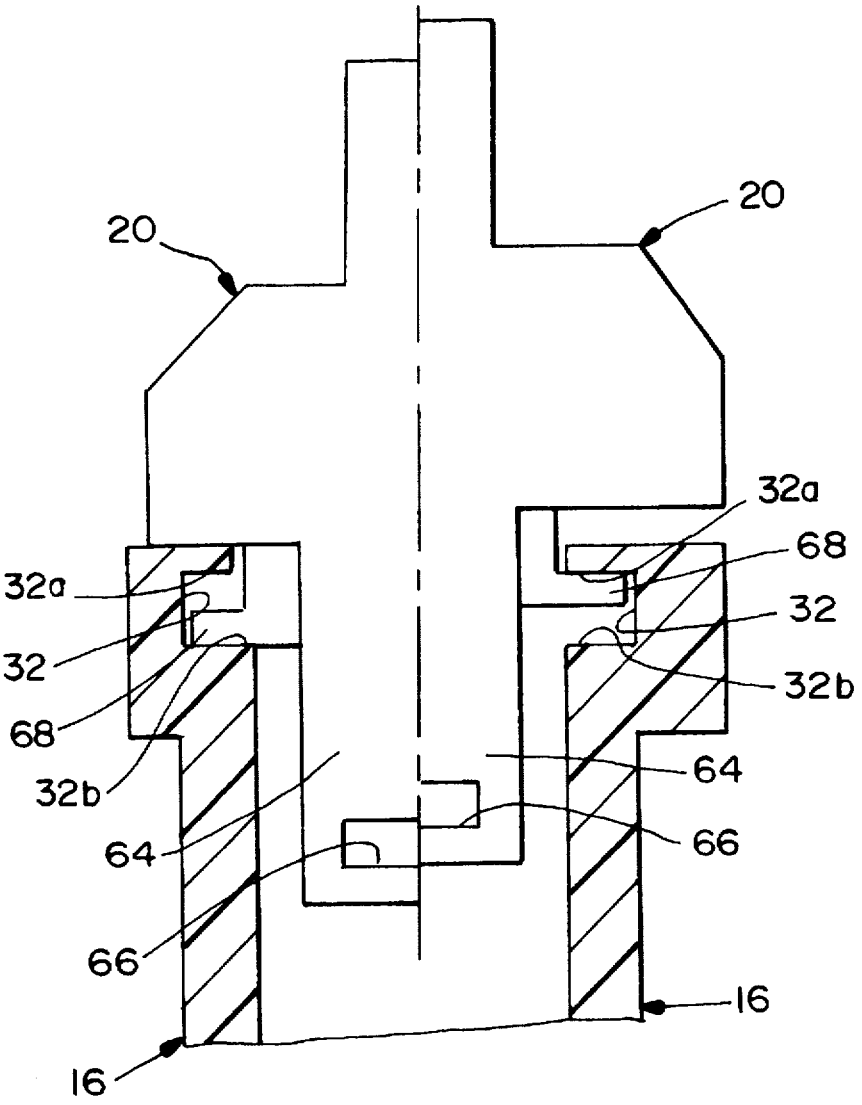
FIG. 6 is a fragmented vertical section, on an enlarged scale, through the stop limit means between the housing and the actuator.

Lastly, FIG. 6 shows the positioning of flanges 66 on the outsides of actuator 20 within grooves 32 on the inside of first housing part 16. In essence, grooves 32 define upper stop limit shoulders **32*a* and lower stop limit shoulders 32*b* against which flanges 68 are engageable. The left-half of FIG. 6 shows flange 68 in engagement with the lower stop limit shoulder 32*b*. This defines the fully latched position of the connectors with actuator 20 in its latched position. The right-half of FIG. 6 shows flange 68 in engagement with the upper stop limit shoulder 32*a* of groove 32. This defines the limit position by which the actuator can pull on latch arm 40, which is sufficient to move latch hooks 46 out of apertures 78** in the header connector. This stop limit means is effective to provide an anti-overstress system to prevent overstressing the latching components which might tend to cause their breakage.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a housing adapted for mating with a complementary electrical device along a mating axis;

a latch on the housing for latching the connector to the complementary electrical device, the latch being movable relative to the housing generally transversely of said axis;

said latch including a latch arm pivotally mounted on the housing for pivotal movement of a latching portion of the arm generally transversely of said axis;

said latch arm being integral with the housing at a fulcrum which pivotally mounts the arm to the housing;

an actuator mounted on the housing for movement relative thereto generally parallel to said axis; and complementary interengaging coupling means between the actuator and the latch for converting axial movement of the actuator to transverse movement of the latch.

2. The electrical connector of claim 1 wherein said latching portion of the latch arm is located on one axial side of said fulcrum, and said actuator includes a manually engageable operating portion located on the opposite axial side of said fulcrum.

3. The electrical connector of claim 2 wherein said coupling means are located on said one axial side of the fulcrum.

4. The electrical connector of claim 1 wherein said actuator comprises a slide member slidably mounted on the housing for linear movement generally parallel to said axis.

5. The electrical connector of claim 4 wherein said housing includes at least two parts sandwiching at least a portion of the slide member therebetween.

6. The electrical connector of claim 1 wherein the connector is adapted for terminating an electrical cable, and said housing and said actuator include opposing portions for embracing the cable.

7. The electrical connector of claim 1, including stop limit means on the housing engageable by the actuator to limit the amount of movement of the actuator generally parallel to said axis.

8. The electrical connector of claim 7 wherein said stop limit means comprise a pair of opposing, axially spaced stop shoulders on the housing, with a stop flange on the actuator located between the shoulders and engageable therewith.

9. The electrical connector of claim 1 wherein said housing includes at least two parts sandwiching at least a portion of the actuator therebetween.

10. The electrical connector of claim 9 wherein said latch is integral with one of said housing parts.

11. The electrical connector of claim 9, including a third housing part adapted for mating with the complementary electrical device.

* * * * *